US008690734B2

(12) United States Patent
Bell

(10) Patent No.: US 8,690,734 B2
(45) Date of Patent: Apr. 8, 2014

(54) VISION EXERCISE DEVICE

(75) Inventor: Brian Mallory Bell, Nicholasville, KY (US)

(73) Assignee: Brian Mallory Bell, Nicholasville, KY (US)

( * ) Notice: Subject to any disclaimer, the term of this patent is extended or adjusted under 35 U.S.C. 154(b) by 351 days.

(21) Appl. No.: 13/137,154

(22) Filed: Jul. 25, 2011

(65) Prior Publication Data

US 2012/0046143 A1 Feb. 23, 2012

Related U.S. Application Data

(60) Provisional application No. 61/370,163, filed on Aug. 3, 2010.

(51) Int. Cl.
*A63B 24/00* (2006.01)

(52) U.S. Cl.
USPC ..... 482/1; 482/148; 351/203

(58) Field of Classification Search
USPC ..... 482/1–9; 606/204.25; 351/201–203
See application file for complete search history.

(56) References Cited

U.S. PATENT DOCUMENTS

| | | | | |
|---|---|---|---|---|
| 2,003,165 | A * | 5/1935 | Wootten | 606/204.25 |
| 5,241,332 | A * | 8/1993 | Farrell | 351/246 |
| 7,452,336 | B2 * | 11/2008 | Thompson | 600/558 |
| 7,483,747 | B2 * | 1/2009 | Gliner et al. | 607/45 |
| 7,726,812 | B2 * | 6/2010 | Dai et al. | 351/203 |
| 8,066,372 | B2 * | 11/2011 | Cooperstock et al. | 351/201 |
| 8,177,732 | B2 * | 5/2012 | Einav et al. | 601/5 |
| 8,306,635 | B2 * | 11/2012 | Pryor | 700/17 |
| 2006/0087618 | A1 * | 4/2006 | Smart et al. | 351/222 |

* cited by examiner

*Primary Examiner* — Glenn Richman

(57) ABSTRACT

An embodiment of the disclosure consists of a rectangular lightweight rigid handled frame, four adjustable telescoping foldout locking legs with protective feet, a rear-facing mirror, a pair of forward-facing mirrors, an eleven-light light source, and a control panel. The rear-facing mirror is connected to the frame and is adjustable about a horizontal axis to form a vertical angle in order to facilitate the reflections from the light source back and forth between the rear-facing mirror and the pair of forward-facing mirrors. The pair of forward-facing mirrors are connected to the frame, are spaced apart to form the porthole, and are adjustable on both a vertical and horizontal axis in order to form the vertical angle and the rotational angle needed to facilitate the reflections from the light source back and forth between the rear-facing mirror and at least one of the pair of forward-facing mirrors.

15 Claims, 7 Drawing Sheets

The Device

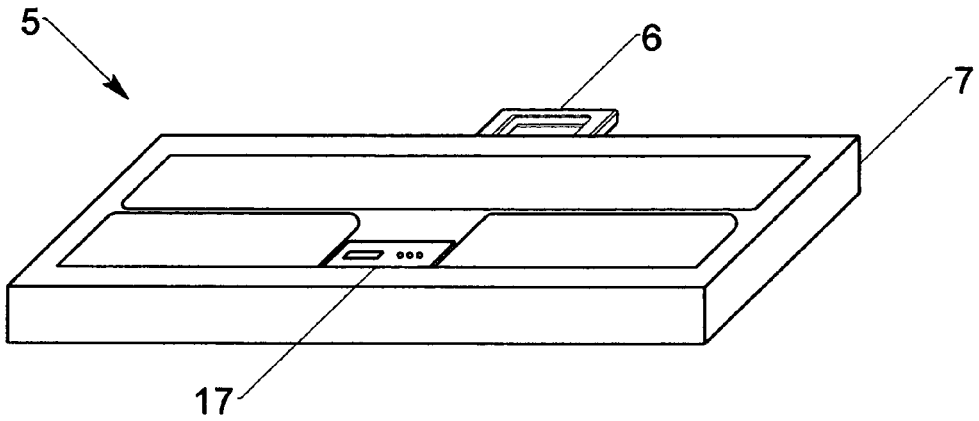
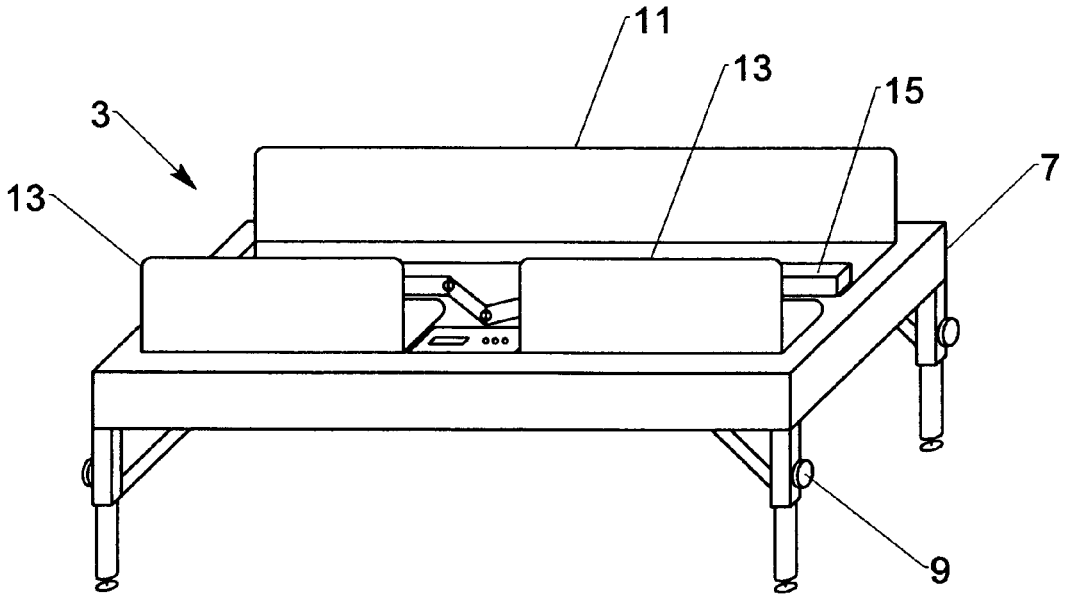
Figure 1: The Device

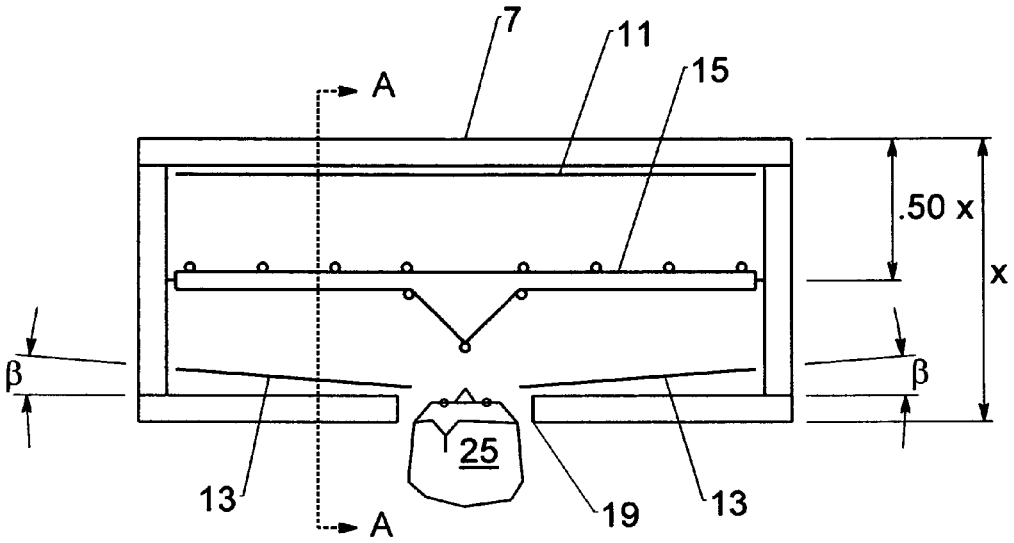
Top View
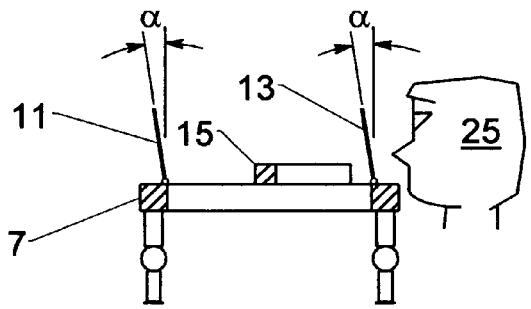
Section A - A
Figure 2: The Mirrors

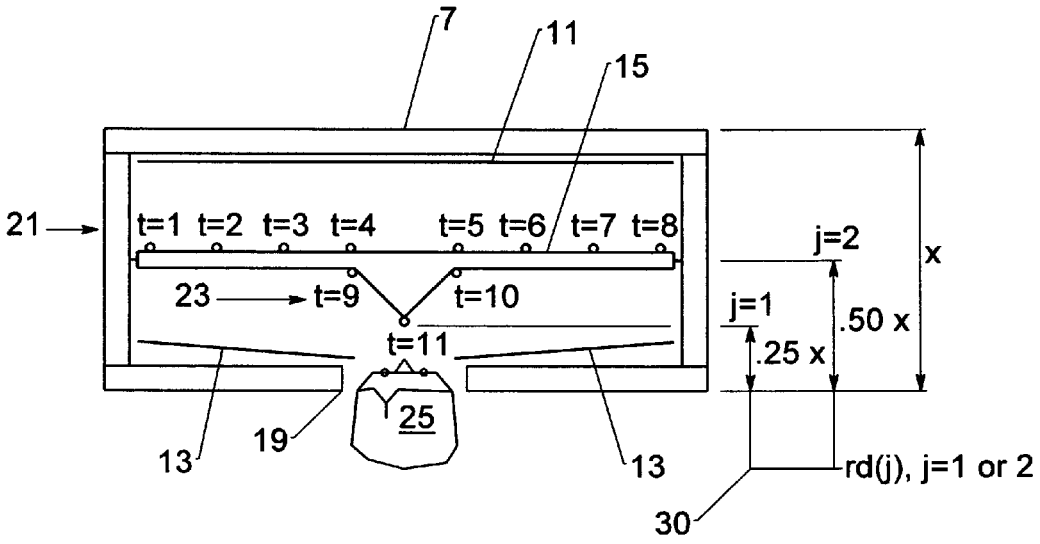
Figure 3: The Light Source

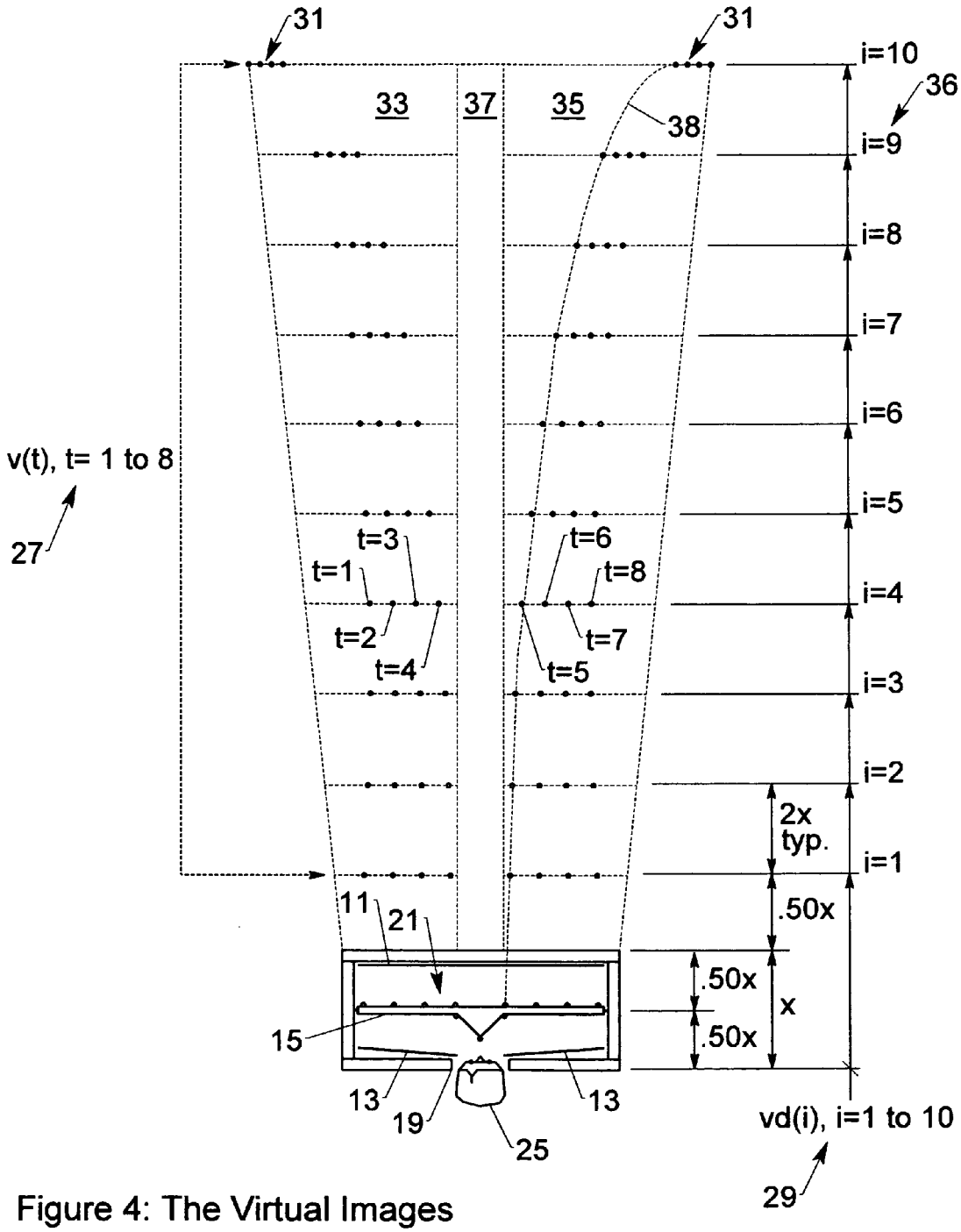
Figure 4: The Virtual Images

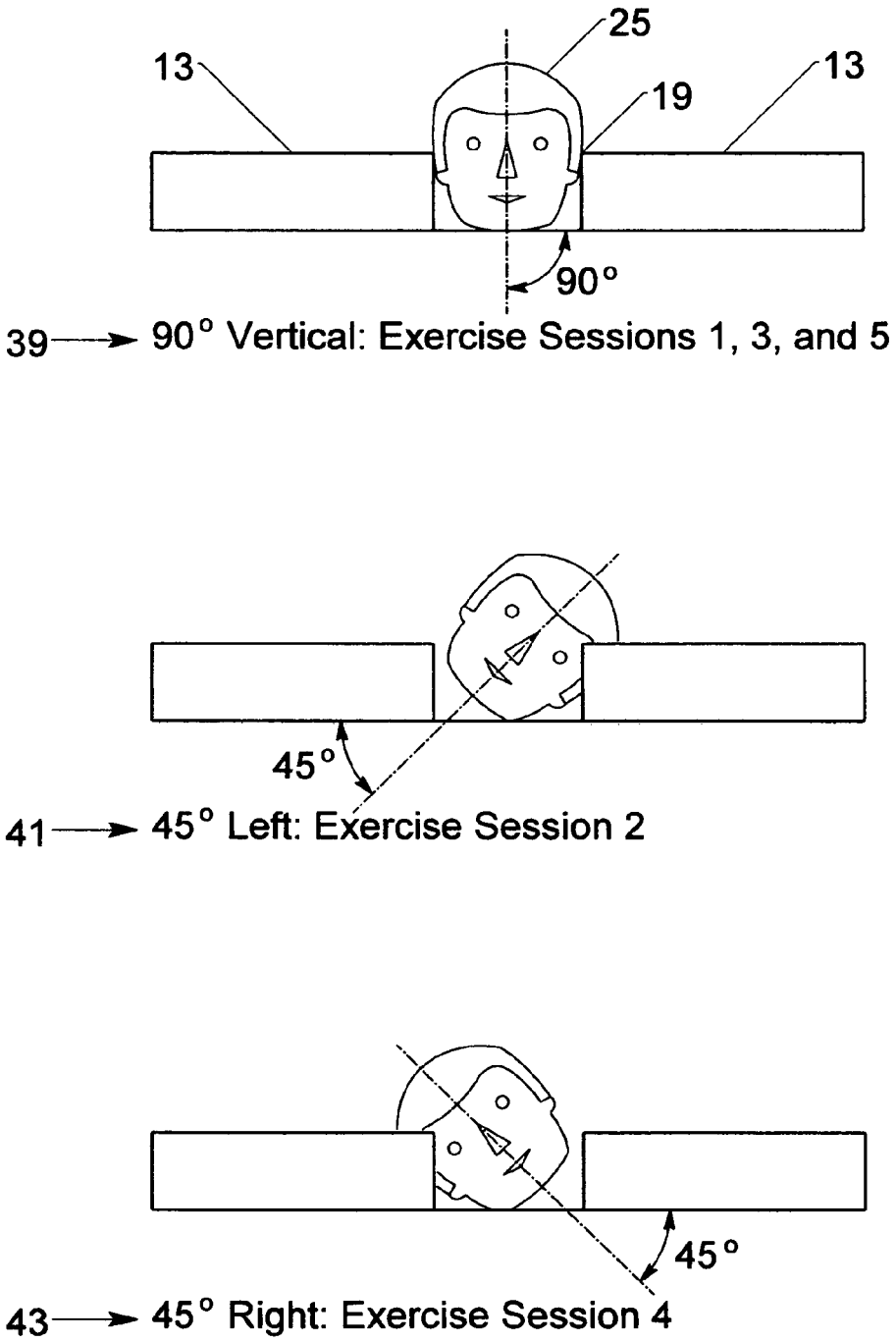
Figure 7: The Starting Positions

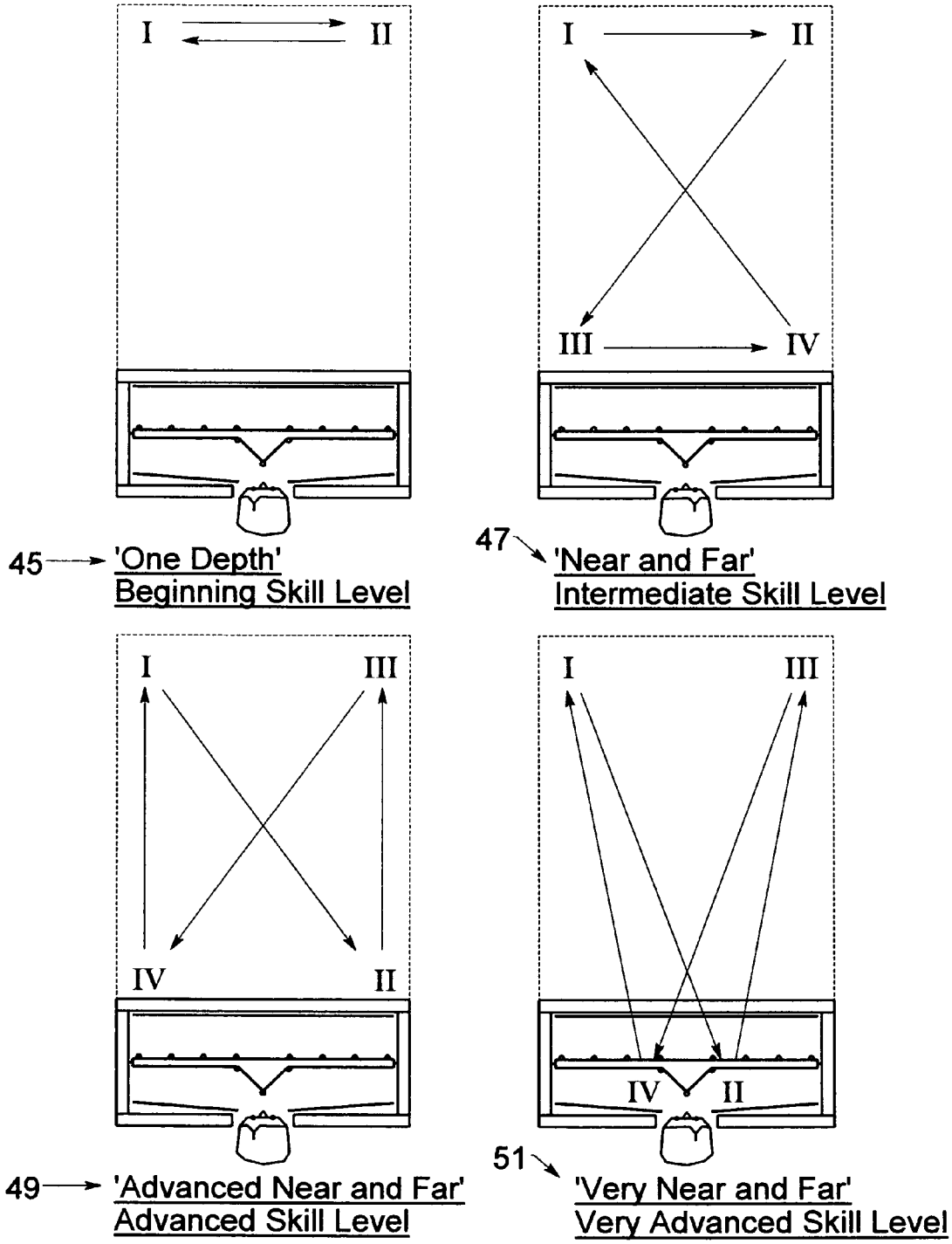
Figure 8: The Viewing Patterns

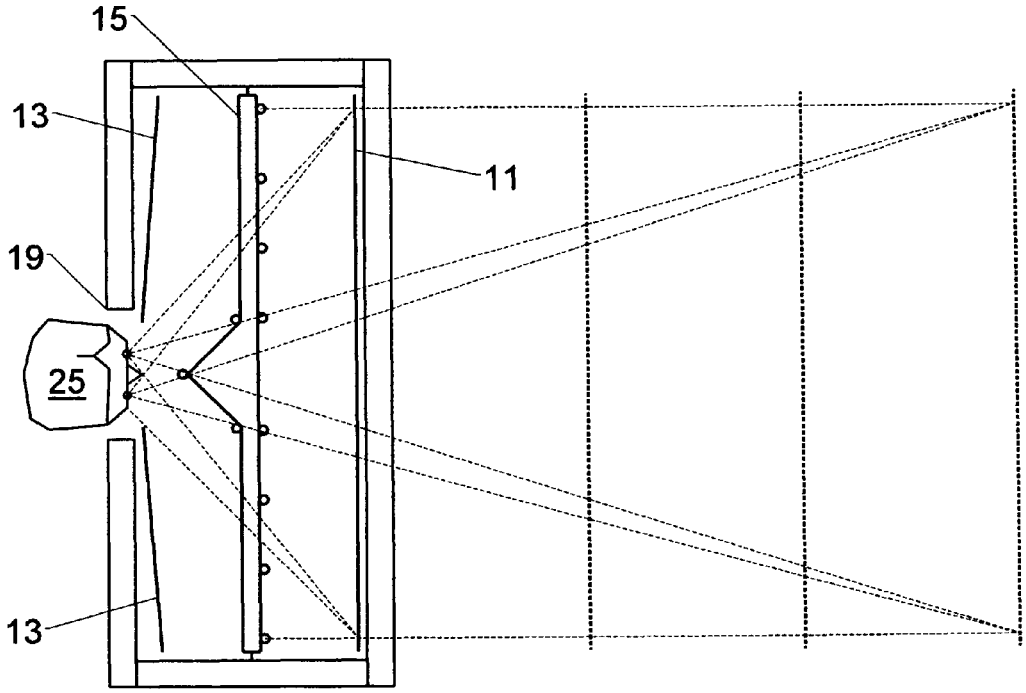
Top View
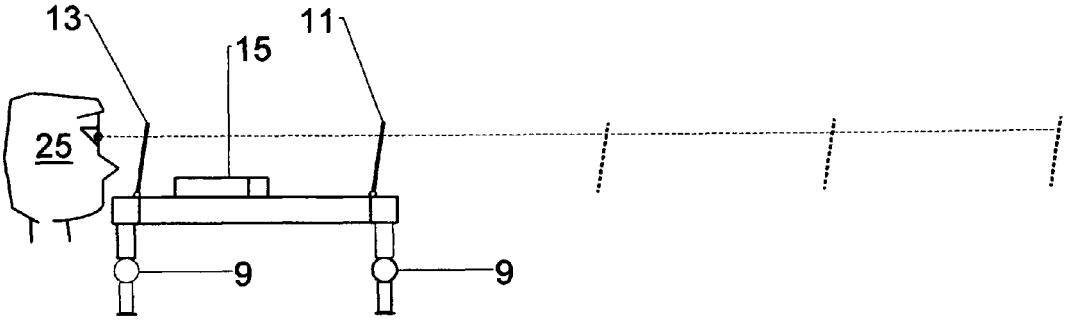
Side View
Figure 9: The Set Up

VISION EXERCISE DEVICE

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The field of endeavor to which the device pertains is the electrical arts. The applicable U.S. Patent Classification is number 482/1, Exercise Devices/Having Specific Electrical Feature. This classification indicates the device is to be operated by a human user for the intended purpose of conditioning a muscle of the user through repeated use. The subclass indicates the device includes a particular electrical component or arrangement.

The information contained herein, pertaining to the invention, was not derived from any outside references, documents, or other information.

BRIEF SUMMARY OF THE INVENTION

The device, referring to FIG. 1, is a vision exercise device that allows the user, following an incremental, progressive, and safe exercise program, to exercise the muscles of the eyes to develop coordination, strength, stamina, and quickness for healthy eyesight. This device puts the eye muscles through a broader range of motions, focal ranges, and light intensities than ordinary eye motions and functions of typical vision experiences. The device is used for vision exercises when in the unfolded-device configuration (3). When not being used for vision exercises, the device is transported as a carrying case in the folded-device configuration (5).

BRIEF DESCRIPTION OF THE SEVERAL VIEWS OF THE DRAWING

FIG. 1: The Device
FIG. 2: The Mirrors
FIG. 3: The Light Source
FIG. 4: The Virtual Images
FIG. 7: The Starting Positions
FIG. 8: The Viewing Patterns
FIG. 9: The Set Up

DETAILED DESCRIPTION OF THE INVENTION

The device, referring to FIG. 1, consists of a rectangular lightweight rigid handled (6) frame (7), further referred to as 'the frame' (7), four adjustable telescoping foldout locking legs (9) with protective feet, further referred to as 'the legs' (9), a rear-facing mirror (11), a pair of forward-facing mirrors (13), a light source (15), and a control panel (17).

The device, referring to FIG. 1, has a frame (7) that conceals and protects the rear-facing mirror (11), the pair of forward-facing mirrors (13), the light source (15), the control panel (17), and the legs (9) when transported as a carrying case in the folded-device configuration (5). The rectangular lightweight rigid handled frame (7) provides for the connection of the rear-facing mirror (11), the pair of forward-facing mirrors (13), the light source (15), the control panel (17), and the legs (9) of the device. When the device is used for vision exercises and in the unfolded-device configuration (3) the frame (7) provides a means by which the rear-facing mirror (11), the pair of forward-facing mirrors (13), the light source (15), and the legs (9) can be positioned and adjusted for use and the control panel (17) can be accessed by the user performing vision exercises, further referred to as 'the user'.

The device, referring now to FIG. 9, has four adjustable telescoping foldout locking legs (9) allowing the set-up of the device being tilted and raised up and down to accommodate heights and positions for typical table top, chair, and user (25) variations, thus comfortably positioning the user (25) at the device.

When unfolded and locked, the legs (9) allow the device, referring now to FIG. 1 to be adjusted to sit in the unfolded-device configuration (3) safely and securely on a table top. The legs (9) are preferably hinged to allow them to be folded inside the device to be transported as a carrying case when in the folded-device configuration (5). The legs (9) are adjustable telescoping locking foldout legs (9) with protective feet, and are connected to the frame (7).

The device, now referring to FIG. 3, has an adjustable rear-facing mirror (11) that faces rearward towards the user (25), facing forward when using the device. The rear-facing mirror (11) is connected to the frame (7) by a hinge and intended to unfold by flipping up from the frame (7) when in use. The device has an adjustable pair of forward-facing mirrors (13) facing the same direction as the user (25) faces when using the device. Each of the pair of forward-facing mirrors (13) is connected to the frame (7) by a hinge and intended to unfold by flipping up from the frame (7) when in use. The pair of forward-facing mirrors (13) is spaced apart to form the porthole (19) at which the user (25) is positioned and through which the user (25) views projections by the light source (15). The rear-facing mirror (11) and the pair of forward-facing mirrors (13) are connected to opposing sides of the frame (7) such that the reflecting side of the rear-facing mirror (11) generally faces the reflecting side of the pair of forward-facing mirrors (13).

The device, referring to FIG. 3, has a light source (15) connected to the frame (7) between the rear-facing mirror (11) and the pair of forward-facing mirrors (13) by a hinge and intended to unfold and lock into position by flipping up from the frame (7) when in use. The light source (15) projects images both forward and rearward. The light source (15) projects images forward from along its linear body and into the rear-facing mirror (11) causing a series of reflections to appear in each of the rear-facing mirror (11) and at least one of the pair of forward-facing mirrors (13). The reflections appearing in rear-facing mirror (11) will be viewed by the user (25) positioned at the porthole (19). Also, the light source (15) preferably projects images rearward directly at the user (25) positioned at the porthole (19). Furthermore, the light source (15) preferably has a speaker that can accompany each projection with an audible sound.

The device, referring now to FIG. 1, has a control panel (17) connected to the frame (7) and consisting of a power source, a display, a key pad, two computer modules, and an electrical connection to the light source (15). When the user turns the power on to the device, the control panel (17) will use the display to prompt the user to enter responses using the key pad. The control panel (17) uses the entered responses from the user to control the light source (15), via an electrical connection.

Each of the light weight plane mirrors of the device, referring to FIG. 2, have one reflective face and consist of one rear-facing mirror (11) and a pair of forward-facing mirrors (13). The rear-facing mirror (11) is preferably horizontally hinged and connected to the frame (7) allowing the rear-facing mirror (11) to pivot up from a folded-device configuration to an unfolded-device configuration and to reflect the projections of the light source (15). Once in the unfolded-device configuration, the rear-facing mirror (11) is further adjustable about a horizontal axis to form a vertical angle α (Section A-A) in order to facilitate in conjunction with the pair of forward-facing mirrors (13) the generation of reflections back and forth between the rear-facing mirror (11) and the pair of forward-facing mirrors (13). The rear-facing mirror (11) is adjusted by vertical angle α (Section A-A) and mounted at a constant distance, x (Top View), from the pair of forward-facing mirrors (13), and a constant distance, 0.5x (Top View), from the light source (15). In a preferred embodiment, the adjustment mechanism for the rear-facing mirror (11) has sufficient resistance to allow the rear-facing mirror (11) to remain in the alignment selected by the user while still enabling the user to adjust the rear-facing mirror (11) by hand.

Referring to FIG. 2, each of the pair of forward-facing mirrors (13) is preferably hinged pivotally and connected to the frame (7) allowing the forward-facing mirrors (13) to pivot up from a folded-device configuration to an unfolded-device configuration and adjust on both a vertical and horizontal axis. Once in the unfolded-device configuration, the pair of forward-facing mirrors (13) are spaced apart to form the porthole (19) and are independently adjustable about both the vertical and horizontal axes in order to form the vertical angle α (Section A-A) and the rotational canting angle β (Top View), in order to facilitate, in conjunction with the rear-facing mirror (11), a reflection of a series of projections from the light source (15) back and forth between the rear-facing mirror (11) and at least one of the pair of forward-facing mirrors (13). In a preferred embodiment, the adjustment mechanism for the forward-facing mirrors (13) has sufficient resistance to allow the forward-facing mirrors (13) to remain in the alignment selected by the user while still enabling adjustment of the forward-facing mirrors (13) by hand.

The electric light source (15) is connected to the frame (7) of the device, referring to FIG. 3, between the rear-facing mirror (11) and the pair of forward-facing mirrors (13) by a hinge and intended to unfold and lock into position by flipping up from folded-device configuration to an unfolded-device configuration. The light source (15) preferably has eleven lights (21, 23) along a linear body. In a preferred embodiment, the light source (15) has eight lights (21) that project forward into the rear-facing mirror (11), and three lights (23) that project rearward directly at the user (25) positioned at the porthole (19).

Furthermore, the light source (15) of the device, referring now to FIG. 1, has an electrical connection to the control panel (17). The light source (15) is controlled by the control panel (17). Moreover, the light source (15) has a speaker that can accompany each light projection with an audible sound.

Virtual images in general that are formed by an object placed between two plane mirrors placed exactly parallel and face-to-face give the appearance of an infinite regress of virtual images, or the formation of an infinite series of receding virtual images. Virtual images in general giving the appearance of an infinite regress will appear farther away and require a change in focus, or accommodation, to be viewed clearly. In general when an object is placed between two plane mirrors placed exactly parallel and face-to-face, the first image of the object will appear to be behind the mirror by exactly the distance between the mirror and the object. Generally, when an object is placed between two plane mirrors placed exactly parallel and face-to-face, each regressing image will appear further behind the preceding image by exactly twice the distance between the mirrors. In a preferred embodiment, referring to FIG. 4, the rear-facing mirror (11) and the pair of forward-facing mirrors (13) are plane mirrors capable of reflecting clear and unaltered virtual images (27) of the lights (21) projected by the light source (15). The virtual images (27), reflected back and forth between the rear-facing mirror (11) and the pair of forward-facing mirrors (13) are exact reproductions, being the same size, shape, and color, of the lights (21) projected by the light source (15). The virtual images (27) reflected by the rear-facing mirror (11) and the pair of forward-facing mirrors (13) will be viewed in the rear-facing mirror (11) by the user (25) positioned at the porthole (19) and appear to be formed 'behind' the rear-facing mirror (11) at ten regressive virtual image distances (29), vd (i), where i=1 to 10. Each virtual image (27), v (t), where t=1 to 8, will be projected by the light source (15) one at a time and appear at all ten regressive virtual image distances (29), vd (i), where i=1 to 10, regressing and separated by a distance equal to 2x, or twice the distance, x, between the rear-facing mirror (11) and the pair of forward-facing mirrors (13). For example in the illustrated embodiment, if the rear-facing mirror (11) and the pair of forward-facing mirrors (13) are separated by a distance x=1'-4", then each of the virtual images (27), v (t), where t=1 to 8, will be projected by the light source (15) one at a time and appear at all ten regressive virtual image distances (29), vd (i), where i=1 to 10, regressing and separated by a distance of 2x=2·1'-4"=2'-8", where x=1'-4".

Referring to FIG. 4, the user (25) positioned at the porthole (19) will view the ten virtual images (27), v (t), where t=1 to 8, 'behind' the rear-facing mirror (11) and regressing behind each other at one of the ten regressive virtual image distances (29), vd (i), where i=1 to 10, at a distance from the user (25) positioned at the porthole (19), generally equating to vd (i)=2x(i−1)+1.5x, where x equals the distance between the rear facing mirror (11) and the pair of forward facing mirrors (13). For a specific example (36), in an ideal embodiment, when x=1'-4", then the user (25) positioned at the porthole (19) will view the virtual images v (t), where t=1 to 8, 'behind' the rear-facing mirror (11) at the ninth of the ten regressive virtual image distances (36), vd (i=9)=2·1'-4"·(9−1)+(1.5·1'-4")=23'-4".

Now referring to FIG. 2, the rear-facing mirror (11) and the pair of forward-facing mirrors (13) are plane mirrors; therefore, the angle of incidence, or entry, of the virtual image into either mirror will exactly equal the angle of reflection, or exit, of the virtual image from out of either mirror. When the pair of forward-facing mirrors (13) is canted at the angle β (Top View) about a rotational vertical axis, then both the angle of incidence, or entry, of the virtual image into either of the pair of forward-facing mirrors (13) and the angle of reflection, or exit, of the virtual image out of either mirror, will both equal β (Top View). In a preferred embodiment, if the pair of forward-facing mirrors (13) is canted at a specific angle β (Top View) greater than zero, then the angles of incidence and reflection will also be greater than zero and equal to β (Top View) and will create a skewed path of virtual images. In a preferred embodiment, this device is set-up with the rear-facing mirror (11) and the pair of forward-facing mirrors (13) slightly tilted away from the user (25) by an angle α (Section A-A), and with the pair of forward-facing mirrors (13) also being slightly canted by angle β (Top View). Therefore, the device's otherwise infinite series of receding virtual images will appear as afinite series of receding virtual images in a skewed path.

Also, in a preferred embodiment, now referring to FIG. 4, the skewed path of ten virtual images (31) at ten regressive virtual image distances (29) will appear all at once for each one of the lights (21) projected as virtual images (27), v (t), where t=1 to 8, in either the left viewing field (33) or the right viewing field (35), separated by a no view zone (37). The lights (21) projected as virtual images (27), v (t), where t=1 to 4, will appear in the left viewing field (33). Likewise, the lights (21) projected as virtual images (27), v (t), where t=5 to 8, will appear in the right viewing field (35). When the device is in use then, only one of the lights (21) projected as virtual images (27) will activate at a time. In a preferred embodiment, when one of the lights (21) projected as virtual images (27) activates, then ten virtual images (27) will appear in regression at each of the ten regressive virtual image distances (29) in either the left viewing field (33) or right viewing field (35). For example, in a preferred embodiment, when the light projected as virtual images v (t=5) activates, then a single skewed path (38) of ten virtual images (31) will appear in the rear-facing mirror (11) and appear to the user (25) positioned at the porthole (19) to be at ten regressive virtual image distances vd (i), where i=1 to 10, (29) in the right viewing field (35). The user (25) must change focus each time one of the virtual images (27) is to be viewed at each of the ten regressive virtual image distances (29).

In an embodiment of the invention, referring to FIG. 3, the device employs the light source (15) for three lights projected as real objects (23), r (t), where t=9 to 11, rearward directly at the user (25) positioned at the porthole (19). The three lights projected as real objects (23), r (t), where t=9 to 11, are not reflected from the rear-facing mirror (11) or the pair of forward-facing mirrors (13), but are viewed directly by the user (25) positioned at the porthole (19), and are located at two real object distances rd (j), where j=1 or 2 (30): rd (j=1)=0.25x; or rd (j=2)=0.5x. For example, in the illustrated embodiment, when x=1'-4", then the light projected as real object r (t=9) would be viewed directly by the user (25) positioned at the porthole (19) at the real object distance (30), rd (j=2) =0.5x=0.5·1'-4"=8". Furthermore, the lights projected as real objects (23), r (t), where t=9 to 11, by the light source (15), are used to exercise accommodation at very near distances.

The exercise schedule module is a computer program and is integral to the control panel of the device. The exercise schedule module is a means by which the device and the user can communicate, via prompts on the display and user entries on the key pad, both before and between each exercise session. The exercise schedule module also compiles a control code, provides the user with the option for a set-up procedure, counts the exercise sessions, and monitors an autonomous non-use counter.

Upon power on the exercise schedule module prompts 'set-up?' for the set-up procedure option and the user selects either to skip or stop the set-up procedure, or to initiate the set-up procedure. Upon receiving the entry from the user to initiate the set-up procedure, the exercise schedule module relieves control from the user, compiles the user entry into a control code of '9999' specific to the set-up procedure, and waits for the next user entry. Otherwise, upon receiving the entry from the user to stop or skip the set-up procedure, the exercise schedule module prompts 'sequence?' for the light sequence and the user enters one of three letters S, J, or R: where S=sequential, J=jumping, and R=random. Next, the exercise schedule module prompts 'pace?' for the projection pace and the user enters one of seven paces: where $1^{st}$=1.75; $2^{nd}$=1.50; $3^{rd}$=1.25; $4^{th}$=1.00; $5^{th}$=0.75; $6^{th}$=0.50; or $7^{th}$=0.25 (seconds of light activation). Next, the exercise schedule module prompts 'sound?' for the audible sound to be on or off and the user selects either sound on or sound of Next, the exercise schedule module prompts 'light?' for the luminance to be constant brightness or varying brightness and the user selects either luminance varying or luminance constant.

Next, the exercise schedule module compiles a four digit exercise session control code based on the user entries. The exercise schedule module uses the user entries to compile the control code, which provides a means of communication within the control panel for the parameters of the light sequence, projection pace, audible sound, and luminance for each exercise session. For example, in the illustrated embodiment, a control code of 'R401', compiled by the exercise schedule module, is interpreted as follows: the first digit 'R' is the light sequence being 'random'; the second digit '4' is the projection pace being '1.00 second of light activation'; the third digit '0' is the audible sound being 'sound off'; and the forth digit '1' is the luminance being 'luminance varying'.

Next, the exercise schedule module sends the exercise session control code to the light source control module and then waits for control to be returned. After each of the five exercise sessions, the exercise schedule module will increment the session counter, after checking for the fifth exercise session to be complete, and after a thirty-second timed delay, will prompt 'start?' for the next exercise session to start and the user selects either to start the next exercise session, or to stop all exercise sessions and power off the device. If after keeping count of the exercise sessions, and the fifth session has been completed and detected by the session counter, then the exercise schedule module turns the power off to the device. Also, the exercise schedule module has an autonomous non-use counter which upon counting three minutes of non-use turns the power off to the device.

The exercise schedule module sets a specific control code for the set-up procedure. The exercise schedule module sets the control code to '9999' automatically after receiving the entry from the user to initiate the set-up procedure and begins the set-up procedure. After the set-up procedure, the exercise schedule module will prompt 'set-up?' for the set-up procedure and the user selects either to skip or stop the set-up procedure, or to initiate the set-up procedure. In a preferred embodiment, the set-up procedure will continue until the user stops the set-up procedure.

The light source control module is a computer program and is integral to the control panel of the device. The light source control module communicates via a control code with the exercise schedule module and controls the light source for an exercise session. The light source control module interprets the control code for the exercise session parameters controlling the light sequence, projection pace, audible sound and luminance, and controls the light source for either an exercise session or for the set-up procedure.

Upon receiving the control code from the exercise schedule module, the light source control module interprets the control code for the exercise parameters controlling the light sequence and sets the parameters to control the light source for one exercise session. The light sequences controlled by the light source control module utilize eight of the lights projected as virtual images, and three lights projected as real objects. The three light sequences stored in the memory of the light source control module are called sequential, jumping, and random. Each light sequence stored in the light source control module memory corresponds with the activation in sequential (S), jumping (J), or random (R) order of lights projected as virtual images and lights projected as real objects. The order of the sequential (S) light sequence controlled by the light source control module is v (t), where t=1-2-3-4-9-10-11-5-6-7-8-7-6-5-11-10-9-4-3-2-1-2-3-4-etc.

Now referring to FIG. 3, the order of the jumping (J) light sequence controlled by the light source control module is v (t), where t=1-8-2-7-3-6-4-5-9-11-10-11-9-5-4-6-3-7-2-8-1-8-2-etc. The order of the random (R) light sequence controlled by the light source control module is v (t=random), for example, t=7-9-3-4-10-2-3-7-7-6-etc. and is produced by a random generator integral to the light source control module.

Next, the light source control module interprets the control code and sets the parameters controlling the projection pace and sets the parameters to control the light source, which projects an exercise session. The seven projection paces are stored in the light source control module memory. The light source control module controls the projection pace, or time in seconds of the duration of the activation of each light projected by the light source, for an exercise session. The seven projection paces stored in the light source control module memory range from a relatively slow 1.75 seconds per light activation to a relatively fast 0.25 seconds per light activation. The light source control module interprets the control code for the exercise session parameters controlling the projection pace, which are set to one of seven projection paces: where the $1^{st}$=1.75; $2^{nd}$=1.50; $3^{rd}$=1.25; $4^{th}$=1.00; $5^{th}$=0.75; $6^{th}$=0.50; and $7^{th}$=0.25 (seconds of light activation).

Next, the light source control module interprets the control code for the exercise session parameters controlling the audible sound, which are set to be either on or of and sets the parameters to control the light source for one exercise session with or without an accompanying sound.

The light source control module interprets the control code for the exercise session parameters controlling the luminance, which are set to be either luminance varying or luminance constant and controls the light source for one exercise session with varying or constant luminance.

The light source control module, after having received the control code from the exercise schedule module, and interpreting the control code for the exercise parameters for the controlling the light sequence, projection pace, audible sound and luminance, sets the parameters to control the light source for an exercise session. The light source control module will activate the light source one light at a time so that each of the activations begins precisely when the previous activation ends, in a light sequence, at a projection pace, with or without an accompanying audible sound, and with either varying or constant luminance. The light source control module will time the exercise session and return control to the exercise schedule module after one and a half minutes.

The light source control module, after receiving and interpreting the set-up procedure control code of '9999' controlling the light sequence, projection pace, audible sound, and luminance, sets the set-up procedure parameters to control the light source for the set-up procedure. The light source control module interprets the control code for the set-up procedure parameters and sets the parameters controlling the light sequence, which are set to activate the lights projected as virtual images to be all activated at the same time. The light source control module interprets the control code for the set-up procedure parameters controlling the projection pace and sets the parameters to infinity allowing all the lights projected as virtual images to remain on constantly. The light source control module interprets the control code for the set-up procedure parameters controlling the audible sound and sets the parameters to off. Next, the light source control module interprets the control code for the set-up procedure parameters controlling the luminance and sets the parameters to luminance constant. The light source control module will both return control to the exercise schedule module and control the light source for the set-up procedure until an exercise session code other than '9999' is received from the exercise schedule module. The light source control module controls the light source for set-up procedure to allow the user to adjust the device into a preferred embodiment.

The user, now referring to FIG. 7, positioned at the porthole (19) formed by the pair of forward-facing mirrors (13), starts each one of the five exercise sessions in one of the three starting positions. The user's (25) head must remain stationary in one of the starting positions to ensure both that the user's eyes are moving and not the user's head, and that the exercise program benefits the eye muscles in a full range of motion. The first, third, and fifth exercise sessions require the user's (25) head to be held stationary in the porthole (19), formed by the pair of forward-facing mirrors (13), in a starting position called '90□ vertical' (39) that is vertical or 90□. However, the second exercise session requires the user's (25) head to be held stationary in the porthole (19), formed by the pair of forward-facing mirrors (13), in a starting position called '45□ left' (41) that is tilted 45□ to the left. Similarly, the fourth exercise session requires the user's (25) head to be held stationary in a starting position called '45□ right' (43) that is tilted 45□ to the right. The starting positions ensure that the user (25) gets the maximum benefit from the exercises during the exercise sessions. The sequence for the starting positions for the five exercise sessions for one exercise day is: $1^{st}$=90□ vertical; $2^{nd}$=45□ left; $3^{rd}$=90□ vertical; $4^{th}$=45□ right; and $5^{th}$=90□ vertical.

The viewing patterns, now referring to FIG. 8, are patterns that the user follows during the exercise sessions. The viewing patterns determine which of the ten regressive virtual image distances, or three real object distances, that the user will focus at during an exercise session. The viewing patterns are followed by the user, but are not controlled by the device. There are many possible viewing patterns. But certain viewing patterns allow the user at different skill levels to benefit the most from the exercise program. The viewing patterns can add interest, variety, and comfort to the exercise program. A user with a beginning skill level will use a viewing pattern, referring to FIG. 8, called 'one depth' (45) and focus on only lights projected as virtual images, and at only one of the ten regressive virtual image distances, for every one virtual image projection for each exercise session. In a preferred embodiment, a user with a beginning skill level using the 'one depth' viewing pattern (45) focuses on only lights projected as virtual images, and at only one regressive virtual image distance, for example vd (i=3) for every one virtual image projection for each exercise session, and uses a 'one depth' viewing pattern (45) described as thus: v (t) at vd (i); specifically v (t=1) at vd (i=3)-v (t=2) at vd (i=3)-v (t=3) at vd (i=3)-v (t=4) at vd (i=3)-etc. (shown in a sequential light sequence).

A user with an intermediate skill level will use a viewing pattern, referring to FIG. 8, called 'near and far' (47) and focus on only lights projected as virtual images, and at two of the ten regressive virtual image distances, changing after every two virtual image projections for each exercise session. In a preferred embodiment, a user with a intermediate skill level using the 'near and far' viewing pattern (47) will focus on only lights projected as virtual images, and at two different regressive virtual image distances, for example vd (i=3), and vd (i=9), changing focal depths after every two virtual image projections for each exercise session, and uses a 'near and far' viewing pattern (47) described as thus: v (t) at vd (i); specifically v (t=1) at vd (i=3)-v (t=2) at vd (i=3)-v (t=3) at vd (i=9)-v (t=4) at vd (i=9)-v (t=5) at vd (i=3)-v (t=6) at vd (i=3)-etc. (shown in a sequential light sequence).

A user with an advanced skill level will use a viewing pattern, referring to FIG. 8, called 'advanced near and far' (49) and focus on only lights projected as virtual images, and at two of the ten regressive virtual image distances, changing after every one virtual image projection for each exercise session. In a preferred embodiment, a user with an advanced skill level using the 'advanced near and far' viewing pattern (49) focuses on only lights projected as virtual images, and at two different regressive virtual image distances, for example vd (i=3), and vd (i=9), changing focal depths after every one virtual image projection for each exercise session, and uses a 'advanced near and far' viewing pattern (49) described as thus: v (t) at vd (i); specifically v (t=1) at vd (i=3)-v (t=2) at vd (i=9)-v (t=3) at vd (i=3)-v (t=4) at vd (i=9)-v (t=5) at vd (i=3)-v (t=6) at vd (i=9)-etc. (shown in a sequential light sequence).

Finally, a user with a very advanced skill level will use a viewing pattern, referring to FIG. 8, called 'very near and far' (51) and focus on both lights projected as virtual images, at one of the ten regressive virtual image distances, and lights projected as real objects, at one of the two real object distances, for every one virtual image projection for each exercise session. In a preferred embodiment, a user with a very advanced skill level using the 'very near and far' viewing pattern (51) focuses on both lights projected as virtual images, at two different regressive virtual image distances, for example vd (i=3), and vd (i=9), and as an alternative to vd (i=3) at one light projected as a real object r (t=10), at one real object distance rd (j=1), changing focal depths after every one virtual image or real object projection for each exercise session, and uses a 'very near and far' viewing pattern (51) described as thus: v (t) at vd (i) or r (t) at rd (j); specifically v (t=1) at vd (i=3)-v (t=2) at vd (i=9)-v (t=3) at vd (i=3)-v (t=4) at vd (i=9)-r (t=10) at rd (j=1)-v (t=5) at vd (i=9)-etc. (shown in a sequential light sequence).

The exercise program presented by this device puts the eye muscles through a broader range of motions, focal ranges, and light intensities than ordinary eye motions and functions of typical vision experiences. The exercise program sends the user through vision exercises for focused positions near and far, left and right, diagonally, up and down, and with changing luminance. The exercise program ranges from easier slow-paced sequential exercises for beginners, to harder fast-paced random exercises for the very advanced users.

The exercise program is performed at home, directed by the user, controlled by the device, and requires no doctor or technician assistance. The exercise program consists of twelve weeks of exercises, five days of exercise per week, and five ninety-second exercise sessions per day of exercise. The eye exercise program can be repeated indefinitely. The exercise program may include an audible sound for assisting the user in responding to changing light activations.

The exercise program consists of the user, the device, the starting positions (FIG. 7), and the viewing patterns (FIG. 8). The device prompts the user to enter responses and compiles a control code setting the parameters for the light sequence, projection pace, audible sound, and luminance, for each exercise session. After compiling the control code, the device begins the exercise session according to the light sequence, projection pace, audible sound, and luminance, specified by the control code. The exercise program also requires the user positioned at the porthole to begin each exercise session from one of the starting positions (FIG. 7). It is in this way that the exercise program allows the eye muscles of the user to move through their entire range of motion. The user uses one of the starting positions (FIG. 7) for each exercise session and holds the starting position (FIG. 7) stationary and positioned at the porthole. Finally, the user focuses on lights projected as virtual images and lights projected as real objects projected by the device following one of the prescribed viewing patterns (FIG. 8).

The set-up, referring now to FIG. 9, consists of unfolding the device from a folded-device configuration to an unfolded-device configuration and adjusting the rear-facing mirror (11) and the pair of forward-facing mirrors (13) using the set-up procedure. The user (25), sitting in a chair, unfolds the device from a folded-device configuration to an unfolded-device configuration by unfolding the four legs (9) and placing the device on a table top. Then, the user (25) adjusts the legs (9) of the device until the porthole (19) is at comfortable eye level and until the device angles a few degrees slightly downhill from front to back, allowing the user's (25) head to be at a comfortable tilt. This is done by adjusting the rear legs (9) of the device down a little relative to the front legs (9) using the adjustment knobs. In a preferred embodiment, adjusting the legs (9) of the device allows for a comfortable viewing height and a slight natural downward tilt of the user's (25) head while using the device. Then the user (25) continues to unfold the device into an unfolded-device configuration by unfolding, or flipping up to a near vertical position, the rear-facing mirror (11) and the pair of forward-facing mirrors (13). Then the user (25) unfolds, flips up into a vertical position and locks in place, the light source (15).

The set-up, referring to FIG. 9, requires the user (25) to adjust the rear-facing mirror (11) and the pair of forward-facing mirrors (13) using the set-up procedure. The user (25) activates the set-up procedure by first turning the power on to the device by using the power button on the control panel. Upon power on, the exercise schedule module (FIG. 5) of the control panel prompts the user (25) to start the set-up procedure. Once the set-up procedure is started, the light source (15) will project all of the lights projected as virtual images at a constant activation and all at once onto the rear-facing mirror (11). The set-up procedure will allow the user (25) to adjust the rear-facing mirror (11) and the pair of forward-facing mirrors (13), and the legs (9) into a preferred embodiment.

Folding the device, referring now to FIG. 1, into the folded-device configuration (5) occurs when the user wants to transport the device by carrying the device by the handle (6). Folding the device into the folded-device configuration (5) includes folding the rear-facing mirror (11) and the pair of forward-facing mirrors (13) down into the frame (7). Folding the device into the folded-device configuration (5) includes unlocking and folding the light source (15) down into the frame (7), and unlocking and folding the legs (9) up and into the frame (7). Completely folding the device into the folded-device configuration (5) allows the device to be transported as a carrying case safely by its handle (6). It should be understood that the device can come in many alternate configurations as well, including a version that is permanently assembled with the mirrors adjustable to form the proper number of virtual images.

The device provides exercise sessions benefiting all the muscles of the eye with full ranges of motions. The device leads the user through exercise sessions, which provide simultaneous exercises for the eye muscles. The exercised muscles include the six extraocular muscles, controlling the movements of the eyes, the ciliary muscle and zonules, controlling the focusing of the lens, and the sphincter and dilator muscles, controlling the opening and closing of the iris.

The six extraocular muscles exercised by the device are called Superior oblique, Superior rectus, Lateral rectus, Medial rectus, Inferior rectus, and Inferior oblique. There are six extraocular muscles controlling the movement of the eyes, allowing one to look in any direction, left and right, diagonally, up and down, and to look at any one point with both eyes. The six extraocular muscles are under one's voluntary control.

The six extraocular muscles are employed by the device during the exercise sessions. During the exercise sessions presented by the device, the six extraocular muscles are employed to follow, or track, lights projected as virtual images or lights projected as real objects. The six extraocular muscles not only compensate for changing positions of the eyes, but also adjust for different focal depths by keeping both eyes trained on a single light projected as a virtual image at one of the ten regressive virtual image distances, or a light projected as a real object at one of the three real object distances. The user exercises all six extraocular muscles in varying degrees by using each of the starting positions (FIG. 7). To ensure that all six of the extraocular muscles are used during the exercise sessions, the user begins each exercise session from alternating starting positions each being held stationary throughout the exercise session. Also to ensure that the six extraocular muscles are employed apart from other muscles, namely the neck muscles, the user holds the starting position (FIG. 7) stationary during the entire exercise session.

The ciliary muscle and zonules exercised by the device consist of the ciliary muscle pairing with the fibers of ciliary zonule, or zonules, to allow for accommodation, the focusing of the lens for different focal depths, or changing and holding focus on objects near or far by working in opposition. The ciliary muscle opposes the zonules, and visa versa, allowing the ciliary muscle and zonules pair to focus and hold focus of the lens on an object at any focal depth. First the zonules, fibrous semi rigid belt or ring, applies tension to the lens holding it in shape for long range focusing. Then, opposing this, the ciliary muscle, a ring of striated smooth muscles being both voluntary and involuntary, pulls on the lens forcing the zonules to release some of their tension, allowing short range focusing. Working together, the ciliary muscle and zonules can focus and hold focus of the lens on an object at any range.

The ciliary muscle and zonules are employed by the device during the exercise sessions taking them through short and long range focusing of the lens on lights projected as virtual images at ten regressive virtual image distances both near and far, and lights projected as real objects at real object distances very near. In one instance, when focusing the lens on lights projected as virtual images at or near the regressive virtual image distance vd (i=10), or virtual infinity, or relatively far, the ciliary muscle is forced to let go allowing the zonules to reshape the lens for long range focusing. However, when focusing the lens on lights projected as virtual images at or near the regressive virtual image distance vd (i=1), or relatively near, or lights projected as real objects at the real object distances rd (j=1), or relatively very near, the ciliary muscle pulls on the lens forcing the zonules to release some of their tension to focus the lens for very near distances.

The sphincter and dilator muscles control the amount of light reaching the retina, expansion of the iris allows more light, and contraction of the iris allows less light to reach the retina. The sphincter and dilator muscles are smooth involuntary muscles. The sphincter muscle contracts the pupil in a circular motion, and the dilator muscle pulls the iris in a radial expansion to enlarge the pupil. The sphincter and dilator muscles work together to contract and expand the aperture, or diameter, of the pupil, the center of the iris.

The sphincter and dilator muscles are employed by the device during the exercise sessions. The sphincter and dilator muscles respond by contracting and expanding the iris in response to exercise sessions presented by the device, providing lights projected as virtual images and lights projected as real objects, at luminance that varies in brightness. The sphincter and dilator muscles are exercised by the exercise sessions presented by this device through a wide range of motion by controlling the expansion and contraction of the iris in response to the varying luminance of both lights projected as virtual images and lights projected as real objects.

I claim:

1. A lightweight, desk-top, handled carrying case, in-home use vision exercise device for exercising the eye muscles of the user while holding his head still and viewing virtual images in the mirrors, the device comprising: a lightweight rigid frame; plane mirrors providing a source of infinite regressive virtual images; two forward facing mirrors and one rear facing mirror, oriented to be viewed through a viewing window with both eyes and perceived with binocular vision, said images having variable virtual viewing distances, illumination intensities, and positions relative to the eyes; a light display system with multiple lights presenting a projection of real images onto said mirrors; a control panel with a microprocessor for controlling the light display system; and four legs for supporting the frame in an optimal viewing stance on a desk-top.

2. The device as claimed in claim 1, wherein the device is folded in a configuration to be a lightweight handled carrying case by folding the hinged mirrors, light source, and legs into its lightweight rigid frame.

3. The device as claimed in claim 1, wherein the device is for in-home use by a non-medically-trained user, presenting elementary set-up and use.

4. The device as claimed in claim 1, wherein the device sits on a desk-top when in use.

5. The device as claimed in claim 1, wherein said plane mirrors consist of two forward facing mirrors and one rear facing mirror which are properly positioned during set-up by hand-adjustable pivoting hinges to produce infinite regressive virtual images at variable virtual viewing distances.

6. The device as claimed in claim 1, wherein said plane mirrors include two forward facing mirrors separated by a space forming a viewing window.

7. The device as claimed in claim 1, wherein said plane mirrors are held in place and positioned by hand-adjustable, pivoting hinges attached to a lightweight rigid frame.

8. The device as claimed in claim 1, wherein said plane mirrors are adjusted to present virtual images at variable virtual viewing distances relative to the user's eyes ranging from 'very near' (1 foot) to 'very far' (virtual infinity, 25 feet) in order for said user to focus his eyes repeatedly on said virtual images presenting at different virtual focal depths in the mirrors.

9. The device as claimed in claim 1, wherein said light display system is hinged to the rigid frame, positioned between said mirrors, and from a stationary position projects real images at various illumination intensities onto the mirrors in order for said user to focus his eyes repeatedly on said virtual images presenting at different illumination intensities in the mirrors.

10. The device as claimed in claim 1, wherein said light display system has multiple lights each capable of projecting real images in various positions relative to the eyes onto the mirrors in order for said user to move his eyes repeatedly on said virtual images to follow said virtual images presenting at different positions in the mirrors.

11. The device as claimed in claim 1, wherein said control panel is integral to and controls the light display system.

12. The device as claimed in claim 1, wherein said control panel functions at an elementary level and is controlled by an in-home user.

13. The device as claimed in claim 1, wherein said control panel is operated by said user to reflect the desired illumination intensity, projection speed, and pattern of real images onto the mirrors.

14. The device as claimed in claim 1, wherein said microprocessor is integral to and produces the desired real images projected by the light display system.

15. The device as claimed in claim 1, wherein four legs support said frame and are telescoping, adjustable, foldout, and locking, with desk-top protective feet, providing the means by which the device is positioned on a desk-top at the proper height and orientation for said user.

* * * * *